US008739802B2

(12) United States Patent
Fagg

(10) Patent No.: US 8,739,802 B2
(45) Date of Patent: Jun. 3, 2014

(54) FILTERED CIGARETTE

(75) Inventor: Barry Smith Fagg, Winston-Salem, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 745 days.

(21) Appl. No.: 11/537,812

(22) Filed: Oct. 2, 2006

(65) Prior Publication Data

US 2008/0142028 A1 Jun. 19, 2008

(51) Int. Cl.

| | |
|---|---|
| ***A24D 1/04*** | (2006.01) |
| ***A24D 3/00*** | (2006.01) |
| ***A24D 1/00*** | (2006.01) |
| ***A24D 3/02*** | (2006.01) |
| ***A24D 3/04*** | (2006.01) |

(52) U.S. Cl.

CPC ..... *A24D 1/045* (2013.01); *A24D 1/002* (2013.01); *A24D 3/0216* (2013.01); *A24D 3/048* (2013.01)

USPC ..... 131/361; 131/334

(58) Field of Classification Search

USPC ..... 131/334, 361

See application file for complete search history.

(56) References Cited

U.S. PATENT DOCUMENTS

| | | | |
|---|---|---|---|
| 1,726,737 | A | 9/1929 | Harris |
| 2,231,076 | A | 1/1940 | Lake et al. |
| 2,792,006 | A | 5/1957 | Marek |
| 2,801,638 | A | 8/1957 | Schur et al. |
| 2,808,057 | A | 10/1957 | Jaksch |
| 2,815,760 | A | 12/1957 | Schreus et al. |
| 2,863,461 | A | 12/1958 | Frost, Jr. |
| 2,881,770 | A | 4/1959 | Touey |
| 2,968,305 | A | 1/1961 | Barnett |
| 3,066,681 | A | 12/1962 | Cohn |
| 3,101,723 | A | 8/1963 | Seligman et al. |
| 3,169,535 | A | 2/1965 | Lassiter et al. |
| 3,217,715 | A | 11/1965 | Berger et al. |
| 3,219,041 | A | 11/1965 | Bromberg |
| 3,234,948 | A | 2/1966 | Stebbings |
| 3,236,244 | A | 2/1966 | Irby, Jr. et al. |
| 3,251,365 | A | 5/1966 | Keith, II et al. |
| 3,270,750 | A | 9/1966 | Campell |
| 3,279,476 | A | 10/1966 | Noznick et al. |
| 3,288,145 | A | 11/1966 | Rosenthal |
| 3,297,038 | A | 1/1967 | Homburger |

(Continued)

FOREIGN PATENT DOCUMENTS

| | | |
|---|---|---|
| DE | 1692936 | 1/1972 |
| EP | 0 359 387 | 3/1990 |

(Continued)

OTHER PUBLICATIONS

Notice of Opposition of European Patent 2 091 363 Nov. 11, 2011.

(Continued)

*Primary Examiner* — Matthew Daniels
*Assistant Examiner* — Cynthia Szewczyk
(74) *Attorney, Agent, or Firm* — Womble Carlyle Sandridge & Rice, LLP

(57) ABSTRACT

A filtered cigarette possesses a smokable rod and a filter element. The filter element possesses a segment incorporating filter material (e.g., cellulose acetate tow) having carbonaceous material (e.g., activated charcoal particles) or other adsorbent dispersed throughout the filter material, and encapsulated flavoring agent (e.g., flavor-containing microcapsules) dispersed throughout the filter material.

28 Claims, 2 Drawing Sheets

(56) References Cited

U.S. PATENT DOCUMENTS

| | | | | |
|---|---|---|---|---|
| 3,311,519 | A | | 3/1967 | Touey et al. |
| 3,320,960 | A | | 5/1967 | Molins |
| 3,334,636 | A | | 8/1967 | Zuber |
| 3,339,557 | A | | 9/1967 | Karalus |
| 3,339,558 | A | | 9/1967 | Waterbury |
| 3,347,247 | A | | 10/1967 | Lloyd |
| 3,349,780 | A | | 10/1967 | Sublett et al. |
| 3,351,071 | A | | 11/1967 | Belfort |
| 3,353,544 | A | | 11/1967 | Fordyce et al. |
| 3,366,121 | A | | 1/1968 | Carty |
| 3,370,592 | A | | 2/1968 | Schultz et al. |
| 3,370,595 | A | | 2/1968 | Davis et al. |
| 3,390,686 | A | | 7/1968 | Irby, Jr. et al. |
| 3,409,018 | A | | 11/1968 | Smith |
| 3,409,020 | A | | 11/1968 | Westbrook, Jr. et al. |
| 3,413,982 | A | | 12/1968 | Sublett et al. |
| 3,420,242 | A | | 1/1969 | Boukair |
| 3,424,168 | A | | 1/1969 | Lloyd |
| 3,428,049 | A | | 2/1969 | Leake et al. |
| 3,460,543 | A | | 8/1969 | Keith, II et al. |
| 3,508,558 | A | | 4/1970 | Seyburn |
| 3,513,859 | A | | 5/1970 | Carty |
| 3,515,146 | A | | 6/1970 | Nealis |
| 3,525,582 | A | | 8/1970 | Waterbury |
| 3,545,345 | A | | 12/1970 | Aronson |
| 3,547,130 | A | | 12/1970 | Harlow |
| 3,550,508 | A | | 12/1970 | Wartman, Jr. et al. |
| 3,575,180 | A | | 4/1971 | Carty |
| 3,596,665 | A | | 8/1971 | Lindgard |
| 3,602,231 | A | | 8/1971 | Dock |
| 3,602,235 | A | | 8/1971 | Dock |
| 3,625,228 | A | | 12/1971 | Dock |
| 3,635,226 | A | | 1/1972 | Horsewell et al. |
| 3,648,711 | A | | 3/1972 | Berger et al. |
| 3,658,069 | A | | 4/1972 | Wise et al. |
| 3,669,128 | A | | 6/1972 | Cohen |
| 3,683,936 | A | | 8/1972 | O'Neil, Jr. |
| 3,685,521 | A | | 8/1972 | Dock |
| 3,713,451 | A | | 1/1973 | Bromberg |
| 3,797,644 | A | | 3/1974 | Shaw |
| 3,858,587 | A | | 1/1975 | Cavelli et al. |
| 3,875,949 | A | | 4/1975 | Harendza-Harinxma et al. |
| 3,884,246 | A | | 5/1975 | Walker |
| 3,894,545 | A | | 7/1975 | Crellin et al. |
| 3,916,914 | A | | 11/1975 | Brooks et al. |
| 3,957,563 | A | | 5/1976 | Sexstone |
| 3,972,335 | A | | 8/1976 | Tiggelbeck et al. |
| 3,991,773 | A | | 11/1976 | Walker |
| 4,003,387 | A | | 1/1977 | Goldstein |
| 4,038,992 | A | | 8/1977 | Ogasa et al. |
| 4,046,063 | A | | 9/1977 | Berger |
| 4,046,153 | A | | 9/1977 | Kaye |
| 4,064,791 | A | | 12/1977 | Berger |
| 4,075,936 | A | | 2/1978 | Berger |
| 4,076,031 | A | | 2/1978 | Grossman |
| 4,082,098 | A | | 4/1978 | Owens, Jr. |
| 4,126,141 | A | | 11/1978 | Grossman |
| 4,163,452 | A | | 8/1979 | Green et al. |
| 4,174,720 | A | | 11/1979 | Hall |
| 4,201,234 | A | | 5/1980 | Neukomm |
| 4,223,597 | A | | 9/1980 | Lebet |
| 4,357,950 | A | | 11/1982 | Berger |
| 4,481,958 | A | | 11/1984 | Rainer et al. |
| 4,508,525 | A | | 4/1985 | Berger |
| 4,677,995 | A | | 7/1987 | Kallianos et al. |
| 4,729,391 | A | | 3/1988 | Woods et al. |
| 4,848,375 | A | | 7/1989 | Patron et al. |
| 4,862,905 | A | | 9/1989 | Green, Jr. et al. |
| 4,865,056 | A | | 9/1989 | Tamaoki et al. |
| 4,881,555 | A | | 11/1989 | Bolt et al. |
| 4,889,144 | A | * | 12/1989 | Tateno et al. ..... 131/337 |
| 4,920,990 | A | | 5/1990 | Lawrence et al. |
| 4,941,486 | A | | 7/1990 | Dube et al. |
| 5,012,828 | A | | 5/1991 | Hayes et al. |
| 5,012,829 | A | | 5/1991 | Thesing et al. |
| 5,025,814 | A | | 6/1991 | Raker |
| 5,067,500 | A | | 11/1991 | Keritsis |
| 5,074,320 | A | | 12/1991 | Jones, Jr. et al. |
| 5,105,838 | A | | 4/1992 | White et al. |
| 5,129,408 | A | | 7/1992 | Jakob et al. |
| 5,133,367 | A | | 7/1992 | Keritsis |
| 5,137,034 | A | | 8/1992 | Perfetti et al. |
| 5,271,419 | A | | 12/1993 | Arzonico et al. |
| 5,331,981 | A | | 7/1994 | Tamaoki et al. |
| 5,360,023 | A | | 11/1994 | Blakley et al. |
| 5,396,909 | A | | 3/1995 | Gentry et al. |
| 5,464,028 | A | | 11/1995 | Takeda et al. |
| 5,472,002 | A | | 12/1995 | Covarrubias |
| 5,549,125 | A | | 8/1996 | White |
| 5,568,819 | A | | 10/1996 | Gentry et al. |
| 5,622,190 | A | | 4/1997 | Arterbery et al. |
| 5,714,126 | A | | 2/1998 | Frund |
| 5,718,250 | A | | 2/1998 | Banerjee et al. |
| 5,724,997 | A | | 3/1998 | Smith et al. |
| 5,746,230 | A | | 5/1998 | Arterbery et al. |
| 5,909,736 | A | | 6/1999 | Stavridis et al. |
| 5,977,346 | A | | 11/1999 | Saka et al. |
| 6,041,790 | A | | 3/2000 | Smith et al. |
| 6,089,238 | A | | 7/2000 | Schneider et al. |
| 6,257,242 | B1 | | 7/2001 | Stavridis |
| 6,417,156 | B1 | | 7/2002 | Smith et al. |
| 6,481,442 | B1 | | 11/2002 | Dyakonov et al. |
| 6,537,186 | B1 | | 3/2003 | Veluz |
| 6,584,979 | B2 | | 7/2003 | Xue et al. |
| 6,595,218 | B1 | | 7/2003 | Koller et al. |
| 6,615,843 | B2 | | 9/2003 | Pera |
| 6,631,722 | B2 | | 10/2003 | MacAdam et al. |
| 6,761,174 | B2 | | 7/2004 | Jupe et al. |
| 6,779,529 | B2 | | 8/2004 | Figlar et al. |
| 6,789,547 | B1 | | 9/2004 | Paine, III |
| 6,789,548 | B2 | | 9/2004 | Bereman |
| 7,115,085 | B2 | | 10/2006 | Deal |
| 7,381,277 | B2 | | 6/2008 | Gonterman et al. |
| 2002/0020420 | A1 | | 2/2002 | Xue et al. |
| 2002/0062833 | A1 | | 5/2002 | Xue et al. |
| 2002/0166563 | A1 | | 11/2002 | Jupe et al. |
| 2003/0031630 | A1 | | 2/2003 | Reznick et al. |
| 2003/0098033 | A1 | | 5/2003 | Macadam et al. |
| 2003/0106562 | A1 | | 6/2003 | Chatterjee |
| 2003/0159703 | A1 | | 8/2003 | Yang et al. |
| 2003/0168070 | A1 | | 9/2003 | Xue et al. |
| 2003/0183237 | A1 | | 10/2003 | Xue et al. |
| 2003/0200973 | A1 | | 10/2003 | Xue et al. |
| 2004/0194792 | A1 | | 10/2004 | Zhuang et al. |
| 2004/0234590 | A1 | | 11/2004 | Mane et al. |
| 2004/0237984 | A1 | | 12/2004 | Figlar et al. |
| 2004/0261807 | A1 | | 12/2004 | Dube et al. |
| 2005/0000531 | A1 | * | 1/2005 | Shi ..... 131/347 |
| 2005/0066982 | A1 | | 3/2005 | Clark et al. |
| 2005/0066983 | A1 | | 3/2005 | Clark et al. |
| 2005/0066984 | A1 | * | 3/2005 | Crooks et al. ..... 131/341 |
| 2006/0112964 | A1 | | 6/2006 | Jupe et al. |
| 2006/0174901 | A1 | | 8/2006 | Karles et al. |
| 2006/0293157 | A1 | | 12/2006 | Deal |
| 2007/0012327 | A1 | | 1/2007 | Karles et al. |
| 2007/0056600 | A1 | | 3/2007 | Coleman,III et al. |
| 2008/0029118 | A1 | | 2/2008 | Nelson et al. |

FOREIGN PATENT DOCUMENTS

| | | | |
|---|---|---|---|
| EP | 0 579 410 | A1 | 1/1994 |
| EP | 0 920 816 | B1 | 6/1999 |
| GB | 1058343 | | 2/1967 |
| GB | 1151660 | | 5/1967 |
| JP | 59-38794 | A | 3/1984 |
| JP | 08-322538 | A | 12/1996 |
| KR | 1999-31274 | | 5/1999 |
| KR | 2000-52283 | | 8/2000 |
| WO | WO 86/04488 | A1 | 8/1986 |
| WO | WO 02/03819 | | 1/2002 |
| WO | WO 02/069745 | A1 | 9/2002 |
| WO | WO 03/000172 | A2 | 1/2003 |

(56) References Cited

FOREIGN PATENT DOCUMENTS

| | | | |
|---|---|---|---|
| WO | WO 03/009711 | A1 | 2/2003 |
| WO | WO 03/015544 | A1 | 2/2003 |
| WO | WO 03/039276 | A1 | 5/2003 |
| WO | WO 03/059096 | A1 | 7/2003 |
| WO | WO 03/086116 | A1 | 10/2003 |
| WO | WO 2004/073427 | A1 | 9/2004 |
| WO | WO 2005/082180 | | 9/2005 |
| WO | WO 2006/082529 | A2 | 8/2006 |

OTHER PUBLICATIONS

Voges, Tobacco Encyclopdia, 1984, p. 67 and 335.

Paper: "Activated Carbons: Activated Carbon for Solvent Recovery," Presented at Meeting of European Petrogravure Assoc. Engineers Group in Mulhouse, France (Mar. 1990). http://www.activated-carbon.com/solrec2.html.

Excerpt from Wikipedia for "Mesh (scale)" http://en.wikipedia.org/wiki/Mesh_(scale), Oct. 15, 2010.

* cited by examiner

FILTERED CIGARETTE

FIELD OF THE INVENTION

The present invention relates to tobacco products, such as smoking articles (e.g., cigarettes), and in particular, to filtered cigarettes.

BACKGROUND OF THE INVENTION

Popular smoking articles, such as cigarettes, have a substantially cylindrical rod shaped structure and include a charge, roll or column of smokable material, such as shredded tobacco (e.g., in cut filler form), surrounded by a paper wrapper, thereby forming a so-called "smokable rod" or "tobacco rod." Normally, a cigarette has a cylindrical filter element aligned in an end-to-end relationship with the tobacco rod. Typically, a filter element comprises plasticized cellulose acetate tow circumscribed by a paper material known as "plug wrap." Certain filter elements can incorporate polyhydric alcohols. Typically, the filter element is attached to one end of the tobacco rod using a circumscribing wrapping material known as "tipping paper." It also has become desirable to perforate the tipping material and plug wrap, in order to provide dilution of drawn mainstream smoke with ambient air. Descriptions of cigarettes and the various components thereof are set forth in Tobacco Production, Chemistry and Technology, Davis et al. (Eds.) (1999). A cigarette is employed by a smoker by lighting one end thereof and burning the tobacco rod. The smoker then receives mainstream smoke into his/her mouth by drawing on the opposite end (e.g., the filter end) of the cigarette.

Certain cigarettes incorporate filter elements incorporating activated carbon or charcoal materials. For example, an exemplary cigarette filter can possess multiple segments, and at least one of those segments can comprise particles of high carbon-content materials. Various types of filters incorporating charcoal particles or activated carbon types of materials are set forth in U.S. Pat. No. 2,881,770 to Touey; U.S. Pat. No. 3,101,723 to Seligman et al.; U.S. Pat. No. 3,236,244 to Irby et al.; U.S. Pat. No. 3,311,519 to Touey et al.; U.S. Pat. No. 3,347,247 to Lloyd; U.S. Pat. No. 3,349,780 to Sublett et al.; U.S. Pat. No. 3,370,595 to Davis et al.; U.S. Pat. No. 3,413,982 to Sublett et al.; U.S. Pat. No. 3,602,231 to Dock; U.S. Pat. No. 3,972,335 to Tigglebeck et al.; U.S. Pat. No. 5,360,023 to Blakley et al.; and U.S. Pat. No. 6,537,186 to Veluz; U.S. patent application Ser. No. 11/226,932 to Coleman, III et al.; and PCT WO 2006/064371 to Banerjea et al. and PCT WO 2006/051422 to Jupe et al.; which are incorporated herein by reference.

It would be highly desirable to provide a cigarette possessing a filter element incorporating a carbonaceous material, such as particles of activated carbon; which filter element (i) incorporates a filter material and other filter component materials, (ii) possesses the ability to efficiently remove effective amounts of various gas phase components of mainstream tobacco smoke passing through that filter element, and (iii) possesses the ability to efficiently provide desired sensory characteristics to mainstream tobacco smoke passing through that filter element.

SUMMARY OF THE INVENTION

The present invention relates to a smoking article, and in particular, a rod shaped smoking article (e.g., a cigarette). The smoking article includes a lighting end (i.e., an upstream end) and a mouth end (i.e., a downstream end). A mouth end piece is located at the extreme mouth end of the smoking article, and the mouth end piece allows the smoking article to be placed in the mouth of the smoker to be drawn upon. The mouth end piece has the form of a filter element. The filter element incorporates an effective amount of an adsorbent material such as a carbonaceous material (e.g., a charcoal or activated carbon type of material). The amount of carbonaceous material or other adsorbent within the filter element is sufficient to alter gas phase components (e.g., reduce the levels of certain gas phase components) in the mainstream smoke passing through the filter element. The filter element incorporates an effective amount of a plurality of particles of encapsulated components that have the ability to alter the sensory characteristics of the mainstream smoke passing through the filter element. For example, the filter element incorporates a plurality of breakable capsules, or rupturable encapsulating materials, incorporating at least one flavoring agent for enhancing or otherwise altering the sensory characteristic of mainstream smoke.

In one embodiment, the invention provides a cigarette comprising a filter element. That filter element possesses a section or segment composed of filter material (e.g., plasticized cellulose acetate tow), and a plurality of flavor-containing capsules dispersed within or throughout the filter material, and carbonaceous material in particulate form dispersed within or throughout the filter material. Such a cigarette typically includes a tobacco rod having smokable filler material contained within a circumscribing wrapping material, and the filter element typically is connected to the tobacco rod at one end of the tobacco rod, the filter element incorporating filter material and having an end proximal to the tobacco rod and an end distal from the tobacco rod.

One preferred embodiment of the invention provides a filtered cigarette comprising a smokable rod and a filter element attached thereto, the filter element comprising at least one segment of filter material, further comprising an adsorbent and an encapsulated flavoring agent dispersed throughout the filter material. The adsorbent can be, for example, activated carbon, molecular sieves, clays, ion exchange resins, activated aluminas, silica gels, meerschaum, or a mixture thereof. The adsorbent is preferably in granular form, such as granules having a particle size of about 10 Mesh to about 400 Mesh, more preferably about 30 Mesh to about 200 Mesh. Granular carbonaceous materials are particularly preferred, including materials with an activity of about 60 to about 150 Carbon Tetrachloride Activity. The amount of adsorbent can vary, and is typically in the range of about 20 mg to about 500 mg, more preferably about 40 mg to about 200 mg.

The encapsulated flavoring agent is typically in the form of a plurality of breakable capsules, such as capsules comprising an outer shell and a payload comprising a flavoring agent contained within the shell. The payload will often comprise a flavoring agent and a carrier, and exemplary flavoring agents include vanilla, coffee, chocolate, cream, mint, spearmint, menthol, peppermint, wintergreen, lavender, cardamon, nutmeg, cinnamon, clove, cascarilla, sandalwood, honey, jasmine, ginger, anise, sage, licorice, lemon, orange, apple, peach, lime, cherry, strawberry, and eucalyptus.

The number and size of capsules will vary, but typically between about 5 and about 1,000 capsules are used, more preferably between about 20 and about 500. The diameter of the capsules is typically between about 0.25 mm to about 3.5 mm, although microcapsules with much smaller diameters can be used. For example, microcapsules with a diameter of about 1 to about 40 microns can be used. The total weight of the capsules used in the filter element of the invention can vary, with an exemplary range being about 10 mg and about 200 mg.

The filter element will often comprise 2 to about 4 filter segments, and preferred filter materials for use therein include fibrous tow materials, such as cellulose acetate tow or polyolefin tow. In one further embodiment, the invention provides a filter element adapted for use with smoking articles, the filter element comprising a first segment of fibrous tow filter material and a second segment of fibrous tow filter material, wherein the first segment of fibrous tow filter material comprises a granular adsorbent material and a plurality of breakable capsules dispersed therein, the breakable capsules comprising a flavoring agent. The second segment of fibrous tow filter material is devoid of granular adsorbent and breakable capsules. The second segment is thus well-suited for use as the mouth end filter segment of a smoking article.

In yet another embodiment of the invention, a cigarette is provided, the cigarette comprising:

(a) a tobacco rod having a smokable filler material contained within a circumscribing wrapping material;

(b) a filter element connected to the tobacco rod at one end of the tobacco rod, said filter element comprising a mouth end segment of fibrous tow filter material and a tobacco end segment of fibrous tow filter material;

(c) a granular carbonaceous material dispersed within the tobacco end segment of filter material; and (d) a plurality of breakable capsules dispersed within the tobacco end segment of filter material, the capsules comprising an outer shell and a liquid or gel payload, the payload comprising a flavoring agent.

BRIEF DESCRIPTION OF THE DRAWINGS

In order to assist the understanding of embodiments of the invention, reference will now be made to the appended drawings, which are not necessarily drawn to scale. The drawing is exemplary only, and should not be construed as limiting the invention.

DETAILED DESCRIPTION OF THE PREFERRED EMBODIMENTS

The present inventions now will be described more fully hereinafter with reference to the accompanying drawing. The invention may be embodied in many different forms and should not be construed as limited to the embodiments set forth herein; rather, these embodiments are provided so that this disclosure will satisfy applicable legal requirements. Like numbers refer to like elements throughout. As used in this specification and the claims, the singular forms "a," "an," and "the" include plural referents unless the context clearly dictates otherwise.

Figure 1:
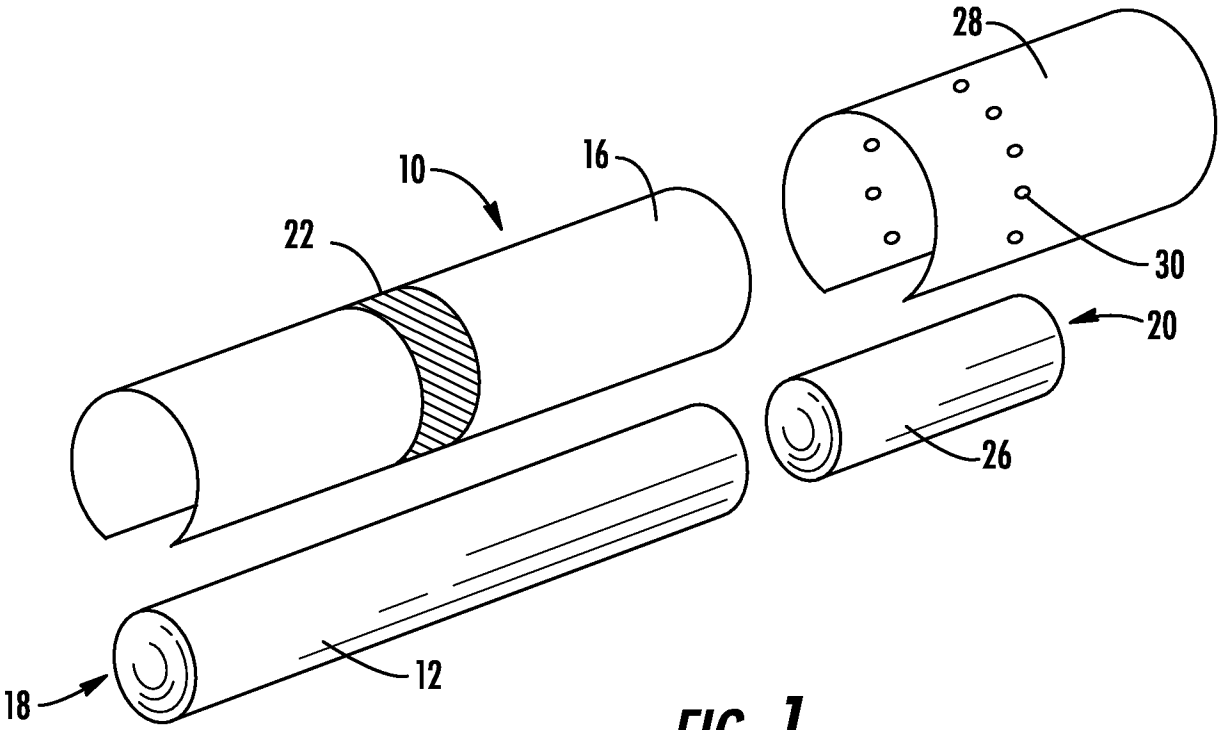
FIG. 1 is an exploded perspective view of a smoking article having the form of a cigarette, showing the smokable material, the wrapping material components, and the filter element of the cigarette.

Referring to FIG. 1, there is shown a smoking article 10 in the form of a cigarette and possessing certain representative components of a smoking article of the present invention. The cigarette 10 includes a generally cylindrical rod 12 of a charge or roll of smokable filler material contained in a circumscribing wrapping material 16. The rod 12 is conventionally referred to as a "tobacco rod." The ends of the tobacco rod 12 are open to expose the smokable filler material. The cigarette 10 is shown as having one optional band 22 (e.g., a printed coating including a film-forming agent, such as starch, ethylcellulose, or sodium alginate) applied to the wrapping material 16, and that band circumscribes the cigarette rod in a direction transverse to the longitudinal axis of the cigarette. That is, the band 22 provides a cross-directional region relative to the longitudinal axis of the cigarette. The band 22 can be printed on the inner surface of the wrapping material (i.e., facing the smokable filler material), or less preferably, on the outer surface of the wrapping material. Although the cigarette can possess a wrapping material having one optional band, the cigarette also can possess wrapping material having further optional spaced bands numbering two, three, or more.

At one end of the tobacco rod 12 is the lighting end 18, and at the mouth end 20 is positioned a filter element 26. The filter element 26 positioned adjacent one end of the tobacco rod 12 such that the filter element and tobacco rod are axially aligned in an end-to-end relationship, preferably abutting one another. Filter element 26 may have a generally cylindrical shape, and the diameter thereof may be essentially equal to the diameter of the tobacco rod. The ends of the filter element 26 permit the passage of air and smoke therethrough.

Figure 2:
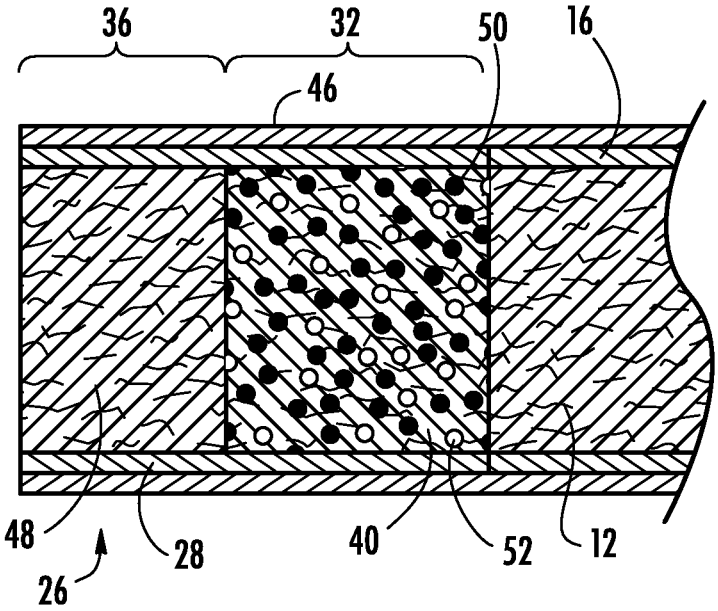
FIG. 2 is a cross-sectional view of one embodiment of a filter element according to the invention.

A preferred filter element 26 configuration is shown in FIG. 2; the filter including a first filter segment 32 positioned adjacent one end of the tobacco rod 12. The first filter segment 32 includes filter material 40 (e.g., cellulose acetate tow impregnated with plasticizer, such as triacetin). Within the filter material 40 of the first segment is dispersed a plurality of particles of an adsorbent 50. Within the filter material 40 of the first segment is also dispersed a plurality of breakable capsules 52. In certain embodiments where a carbonaceous material is used as the adsorbent 50, at least a portion of the carbonaceous material, and typically virtually all of the carbonaceous material, is in intimate contact with an effective amount of a mixture of polyol ester (e.g., triacetin) and polyol (e.g., propylene glycol). If desired, the filter element also can be incorporate other components that have the ability to alter the properties of the mainstream smoke that passes throughout the filter element. See, for example, U.S. Pat. Application Publication Nos. 2004/0237984 to Figlar et al.; 2005/0268925 to Schluter et al.; 2006/0130861 to Luan et al.; and 2006/0174899 to Luan et al., which are incorporated herein by reference.

The filter element 26 possesses a second filter segment 36 longitudinally disposed relative to the first segment 32 and positioned at the extreme mouth end of the cigarette 10. The second filter segment 36 includes filter material 48 (e.g., cellulose acetate tow impregnated with plasticizer, such as triacetin) that is over-wrapped along the longitudinally extending surface thereof with circumscribing plug wrap material 28. The second filter segment 36 is preferably substantially free of adsorbent and breakable capsules, meaning that such additives are not visible when viewing the extreme mouth end of the filter element 26.

The filter element 26 is circumscribed along its outer circumference or longitudinal periphery by a layer of outer plug wrap 28. The outer plug wrap 28 overlies each of the first filter segment 32 and the second filter segment 36, so as to provide a combined, two-segment filter element.

The filter element 26 is attached to the tobacco rod 12 using tipping material 46 (e.g., essentially air impermeable tipping paper), that circumscribes both the entire length of the filter element 26 and an adjacent region of the tobacco rod 12. The inner surface of the tipping material 46 is fixedly secured to the outer surface of the plug wrap 28 and the outer surface of the wrapping material 16 of the tobacco rod, using a suitable adhesive; and hence, the filter element and the tobacco rod are connected to one another.

A ventilated or air diluted smoking article can be provided with an optional air dilution means, such as a series of perforations 30, each of which extend through the tipping material and plug wrap. The optional perforations 30, shown in FIG. 1, can be made by various techniques known to those of ordinary skill in the art, such as laser perforation techniques. Alternatively, so-called off-line air dilution techniques can be used (e.g., through the use of porous paper plug wrap and preperforated tipping paper). For cigarettes that are air diluted or ventilated, the amount or degree of air dilution or ventilation can vary. Frequently, the amount of air dilution for an air diluted cigarette is greater than about 10 percent, generally is greater than about 20 percent, often is greater than about 30 percent, and sometimes is greater than about 40 percent. Typically, the upper level for air dilution for an air diluted cigarette is less than about 80 percent, and often is less than about 70 percent. As used herein, the term "air dilution" is the ratio (expressed as a percentage) of the volume of air drawn through the air dilution means to the total volume and air and smoke drawn through the cigarette and exiting the extreme mouth end portion of the cigarette.

During use, the smoker lights the lighting end 18 of the cigarette 10 using a match or cigarette lighter. As such, the smokable material 12 begins to burn. The mouth end 20 of the cigarette 10 is placed in the lips of the smoker. Thermal decomposition products (e.g., components of tobacco smoke) generated by the burning smokable material 12 are drawn through the cigarette 10, through the filter element 26, and into the mouth of the smoker. During draw, certain amount of certain gaseous components of the mainstream smoke are removed from the mainstream smoke by the particles of adsorbent 50 within the filter element 26. Filters incorporating adsorbent materials, such as carbonaceous filter components (e.g., activated charcoal particles), have the capability of capturing a wide range of mainstream tobacco smoke vapor phase components. If desired, prior to, during or after the smoking experience, the smoker can squeeze the filter element. As a result, at least a portion of the capsules 52 that remain unbroken can be broken, and hence release the flavoring agent contained therein.

Other filter element arrangements could be used without departing from the invention. For example, the filter element could include more than the two segments set forth in FIG. 2. Although less preferred, the filter element could also include a cavity formed between two filter material segments, with the adsorbent and the capsules including the flavoring agent mixed together therein. Although it is preferable to avoid positioning the filter segment comprising the adsorbent and flavor capsules at the extreme mouth end of the filter, it is not necessary for the filter segment comprising these additives to be located at the tobacco end of the filter. Instead, the filter segment comprising the dispersed additives can be more centrally located within the filter element with one or more filter segments that do not contain the additives on each side.

The dimensions of a representative cigarette 10 can vary. Preferred cigarettes are rod shaped, and can have diameters of about 7.5 mm (e.g., circumferences of about 20 mm to about 27 mm, often about 22.5 mm to about 25 mm); and can have total lengths of about 70 mm to about 120 mm, often about 80 mm to about 100 mm. The length of the filter element 30 can vary. Typical filter elements can have total lengths of about 15 mm to about 40 mm, often about 20 mm to about 35 mm. For a typical dual-segment filter element, the downstream or mouth end filter segment often has a length of about 10 mm to about 20 mm; and the upstream or tobacco rod end filter segment often has a length of about 10 mm to about 20 mm.

Cigarette rods typically are manufactured using a cigarette making machine, such as a conventional automated cigarette rod making machine. Exemplary cigarette rod making machines are of the type commercially available from Molins PLC or Hauni-Werke Korber & Co. KG. For example, cigarette rod making machines of the type known as MkX (commercially available from Molins PLC) or PROTOS (commercially available from Hauni-Werke Korber & Co. KG) can be employed. A description of a PROTOS cigarette making machine is provided in U.S. Pat. No. 4,474,190 to Brand, at col. 5, line 48 through col. 8, line 3, which is incorporated herein by reference. Types of equipment suitable for the manufacture of cigarettes also are set forth in U.S. Pat. No. 4,781,203 to La Hue; U.S. Pat. No. 4,844,100 to Holznagel; U.S. Pat. No. 5,131,416 to Gentry; U.S. Pat. No. 5,156,169 to Holmes et al.; U.S. Pat. No. 5,191,906 to Myracle, Jr. et al.; U.S. Pat. No. 6,647,870 to Blau et al.; U.S. Pat. No. 6,848,449 to Kitao et al.; and U.S. Pat. No. 6,904,917 to Kitao et al.; and U.S. Patent Application Publication Nos. 2003/0145866 to Hartman; 2004/0129281 to Hancock et al.; 2005/0039764 to Barnes et al.; and 2005/0076929 to Fitzgerald et al.; each of which is incorporated herein by reference.

The components and operation of conventional automated cigarette making machines will be readily apparent to those skilled in the art of cigarette making machinery design and operation. For example, descriptions of the components and operation of several types of chimneys, tobacco filler supply equipment, suction conveyor systems and garniture systems are set forth in U.S. Pat. No. 3,288,147 to Molins et al.; U.S. Pat. No. 3,915,176 to Heitmann et al.; U.S. Pat. No. 4,291,713 to Frank; U.S. Pat. No. 4,574,816 to Rudszinat; U.S. Pat. No. 4,736,754 to Heitmann et al. U.S. Pat. No. 4,878,506 to Pinck et al.; U.S. Pat. No. 5,060,665 to Heitmann; U.S. Pat. No. 5,012,823 to Keritsis et al. and U.S. Pat. No. 6,360,751 to Fagg et al.; and U.S. Patent Publication No. 2003/0136419 to Muller; each of which is incorporated herein by reference. The automated cigarette making machines of the type set forth herein provide a formed continuous cigarette rod or smokable rod that can be subdivided into formed smokable rods of desired lengths.

Various types of cigarette components, including tobacco types, tobacco blends, top dressing and casing materials, blend packing densities and types of paper wrapping materials for tobacco rods, can be employed. See, for example, the various representative types of cigarette components, as well as the various cigarette designs, formats, configurations and characteristics, that are set forth in Johnson, Development of Cigarette Components to Meet Industry Needs, 52$^{nd}$ T.S.R.C. (September, 1998); U.S. Pat. No. 5,101,839 to Jakob et al.; U.S. Pat. No. 5,159,944 to Arzonico et al.; U.S. Pat. No. 5,220,930 to Gentry and U.S. Pat. No. 6,779,530 to Kraker; U.S. Patent Publication Nos. 2005/0016556 to Ashcraft et al.; 2005/0066986 to Nestor et al.; and 2005/0076929 to Fitzgerald et al.; and U.S. patent application Ser. No. 11/226,932, filed Sep. 14, 2005, to Coleman, III et al.; Ser. No. 11/375,700, filed Mar. 14, 2006, to Thomas et al. and Ser. No. 11/408,625, filed Apr. 21, 2006, to Oglesby; each of which is incorporated herein by reference. Most preferably, the entire smokable rod is composed of smokable material (e.g., tobacco cut filler) and a layer of circumscribing outer wrapping material.

Filter element components or segments for filter elements for multi-segment filtered cigarettes typically are provided from filter rods that are produced using traditional types of rod-forming units, such as those available as KDF-2 and KDF-3E from Hauni-Werke Korber & Co. KG. Typically, filter material, such as filter tow, is provided using a tow processing unit. An exemplary tow processing unit has been commercially available as E-60 supplied by Arjay Equipment Corp., Winston-Salem, N.C. Other exemplary tow processing units have been commercially available as AF-2, AF-3, and AF-4 from Hauni-Werke Korber & Co. KG. In addition, representative manners and methods for operating a filter material supply units and filter-making units are set forth in U.S. Pat. No. 4,281,671 to Byrne; U.S. Pat. No. 4,862,905 to Green, Jr. et al.; U.S. Pat. No. 5,060,664 to Siems et al.; U.S. Pat. No. 5,387,285 to Rivers; and U.S. Pat. No. 7,074,170 to Lanier, Jr. et al. Other types of technologies for supplying filter materials to a filter rod-forming unit are set forth in U.S. Pat. No. 4,807,809 to Pryor et al. and U.S. Pat. No. 5,025,814 to Raker; which are incorporated herein by reference.

Cigarette filter rods can be used to provide multi-segment filter rods. Such multi-segment filter rods then can be employed for the production of filtered cigarettes possessing multi-segment filter elements. An example of a two-segment filter element is a filter element possessing a first cylindrical segment incorporating activated charcoal particles dispersed within or throughout cellulose acetate tow (e.g., a "dalmation" type of filter segment) at one end, and a second cylindrical segment that is produced from a filter rod produced essentially of plasticized cellulose acetate tow filter material at the other end. Filter elements also can have the form of so-called "patch filters" and possess segments incorporating carbonaceous materials and rupturable microencapsulated materials. The production of multi-segment filter rods can be carried out using the types of rod-forming units that traditionally have been employed to provide multi-segment cigarette filter components. Multi-segment cigarette filter rods can be manufactured using a cigarette filter rod making device available under the brand name Mulfi from Hauni-Werke Korber & Co. KG of Hamburg, Germany. Representative types of filter designs and components, including representative types of segmented cigarette filters, are set forth in U.S. Pat. No. 4,920,990 to Lawrence et al.; U.S. Pat. No. 5,012,829 to Thesing et al.; U.S. Pat. No. 5,025,814 to Raker; U.S. Pat. No. 5,074,320 to Jones et al.; U.S. Pat. No. 5,105,838 to White et al.; U.S. Pat. No. 5,271,419 to Arzonico et al.; U.S. Pat. No. 5,360,023 to Blakley et al.; U.S. Pat. No. 5,396,909 to Gentry et al.; and U.S. Pat. No. 5,718,250 to Banerjee et al; U.S. Pat. Appl. Pub. Nos. 2002/0166563 to Jupe et al., 2004/0261807 to Dube et al.; 2005/0066981 to Crooks et al.; 2006/0090769 to Woodson; 2006/0124142 to Zhang et al.; 2006/0144412 to Mishra et al., and 2006/0157070 to Belcastro et al.; PCT Publication No. WO 03/009711 to Kim; PCT Publication No. WO 03/047836 to Xue et al.; and U.S. patent application Ser. No. 11/226,932, filed Sep. 14, 2005, to Coleman III, et al.; which are incorporated herein by reference.

Multi-segment filter elements typically are provided from so-called "six-up" filter rods, "four-up" filter rods and "two-up" filter rods that are of the general format and configuration conventionally used for the manufacture of filtered cigarettes can be handled using conventional-type or suitably modified cigarette rod handling devices, such as tipping devices available as Lab MAX, MAX, MAX S or MAX 80 from Hauni-Werke Korber & Co. KG. See, for example, the types of devices set forth in U.S. Pat. No. 3,308,600 to Erdmann et al.; U.S. Pat. No. 4,281,670 to Heitmann et al.; U.S. Pat. No. 4,280,187 to Reuland et al.; U.S. Pat. No. 4,850,301 to Greene, Jr. et al.; and U.S. Pat. No. 6,229,115 to Vos et al.; and U.S. Patent Application Publication Nos. 2005/0103355 to Holmes, 2005/1094014 to Read, Jr., and 2006/0169295 to Draghetti, each of which is incorporated herein by reference.

The filter material can vary, and can be any material of the type that can be employed for providing a tobacco smoke filter for cigarettes. Preferably a traditional cigarette filter material is used, such as cellulose acetate tow, gathered cellulose acetate web, polypropylene tow, gathered cellulose acetate web, gathered paper, strands of reconstituted tobacco, or the like. Especially preferred is filamentary or fibrous tow such as cellulose acetate, polyolefins such as polypropylene, or the like. One filter material that can provide a suitable filter rod is cellulose acetate tow having 3 denier per filament and 40,000 total denier. As another example, cellulose acetate tow having 3 denier per filament and 35,000 total denier can provide a suitable filter rod. As another example, cellulose acetate tow having 8 denier per filament and 40,000 total denier can provide a suitable filter rod. For further examples, see the types of filter materials set forth in U.S. Pat. No. 3,424,172 to Neurath; U.S. Pat. No. 4,811,745 to Cohen et al.; U.S. Pat. No. 4,925,602 to Hill et al.; U.S. Pat. No. 5,225,277 to Takegawa et al. and U.S. Pat. No. 5,271,419 to Arzonico et al.; each of which is incorporated herein by reference.

Normally a plasticizer such as triacetin or carbowax is applied to the filamentary tow in traditional amounts using known techniques. In one embodiment, the plasticizer component of the filter material comprises triacetin and carbowax in a 1:1 ratio by weight. The total amount of plasticizer is generally about 4 to about 20 percent by weight, preferably about 6 to about 12 percent by weight. Other suitable materials or additives used in connection with the construction of the filter element will be readily apparent to those skilled in the art of cigarette filter design and manufacture. See, for example, U.S. Pat. No. 5,387,285 to Rivers, which is incorporated herein by reference.

If desired, suitable catalytic compounds, e.g., for the conversion of carbon monoxide to carbon dioxide, can be incorporated into one or more segments of the filter element 26. Exemplary catalysts include noble metals (e.g., silver, gold, platinum), metal oxides, ceramics, and mixtures thereof.

As illustrated in FIG. 2, the filter element of the invention typically comprises multiple, longitudinally-extending segments. Each segment can have varying properties and may include various materials capable of filtration or adsorption of particulate matter and/or vapor phase compounds. Typically, the filter element of the invention includes 2 to 6 segments, frequently 2 to 4 segments. In one preferred embodiment, the filter element includes a mouth end segment and a tobacco end segment, with the tobacco end segment comprising the dispersed adsorbent and flavor capsules.

As shown in FIG. 2, the filter element incorporates an adsorbent material. The adsorbent material 50 can be a material with relatively high surface area capable of adsorbing smoke constituents without a high degree of specificity, or a material that adsorbs certain compounds with a greater degree of specificity, such as an ion exchange resin. Exemplary types of adsorbent 50 include activated carbon, molecular sieves (e.g., zeolites and carbon molecular sieves), clays, ion exchange resins, activated aluminas, silica gels, meerschaum, and mixtures thereof. Any adsorbent material, or mixture of materials, that has the ability to alter the character or nature of mainstream smoke passing through the filter element could be used.

Exemplary ion exchange resins comprises a polymer backbone, such as styrene-divinylbenzene (DVB) copolymers, acrylates, methacrylates, phenol formaldehyde condensates, and epichlorohydrin amine condensates, and a plurality of electrically charged functional groups attached to the polymer backbone, and can be a weak base anion exchange resin or a strong base anion exchange resin. Commercially available embodiments of such resins include DIAION® ion-exchange resins available from Mitsubishi Chemical Corp. (e.g., WA30 and DCA11), DUOLITE® ion exchange resins available from Rohm and Haas (e.g., DUOLITE® A7), and XORBEX resins available from Dalian Trico Chemical Co. of China.

A preferred adsorbent is a carbonaceous material, which is a material that is composed primarily of carbon, and preferred carbonaceous materials are composed of virtually all carbon. Typically carbonaceous materials comprise carbon in amounts of more than about 85 percent, generally more than about 90 percent, often more than about 95 percent, and frequently more than about 98 percent, by weight. The carbonaceous material can have the form of charcoal, but most preferably is an activated carbon material. Activated carbon materials are high surface area materials. Exemplary activated carbon materials have surface areas of more than about 200 $m^2/g$, often more than about 1000 $m^2/g$, and frequently more than about 1500 $m^2/g$, as determined using the Brunaver, Emmet and Teller (BET) method described in J. Amer. Chem. Soc., Vol. 60(2), pp. 309-319 (1938).

The filter element incorporates an effective amount of adsorbent, and preferably an effective amount of activated carbon. The effective amount is an amount that, when incorporated into the filter element, provides some desired degree of alteration of the mainstream smoke of a cigarette incorporating that filter element. For example, a cigarette filter element incorporating activated carbon particles or granules can act to lower the yield of certain gas phase components of the mainstream smoke passing through that filter element. Typically, the amount of carbonaceous material or other adsorbent within the filter element is at least about 20 mg, often at least about 30 mg, and frequently at least about 40 mg, on a dry weight basis. Typically, the amount of carbonaceous material or other adsorbent within the filter element does not exceed about 500 mg, generally does not exceed about 400 mg, often does not exceed about 300 mg, and frequently does not exceed about 200 mg, on a dry weight basis.

The carbonaceous material or other adsorbent of the filter element is employed in a suitable form. For example, the carbonaceous material or other adsorbent can have a form that can be characterized as powdered, granular, particulate form, or the like. Typical average particle sizes are greater than about 10 Mesh, often greater than about 20 Mesh, and frequently greater than about 30 Mesh. Typical particle sizes are less than about 400 Mesh, often less than about 300 Mesh, and frequently less than about 200 Mesh. The terms "granular" and "particulate" are intended to encompass both non-spherical shaped particles and spherical particles, such as so-called "beaded carbon" described in WO 03/059096 A1, which is incorporated by reference herein.

The carbonaceous materials can be derived from synthetic or natural sources. Materials such as rayon or nylon can be carbonized, followed by treatment with oxygen to provide activated carbonaceous materials. Materials such as wood and coconut shells can be carbonized, followed by treatment with oxygen to provide activated carbonaceous materials. The level of activity of the carbon may vary. Typically, the carbon has an activity of about 60 to about 150 Carbon Tetrachloride Activity (i.e., weight percent pickup of carbon tetrachloride). Preferred carbonaceous materials are provided by carbonizing or pyrolyzing bituminous coal, tobacco material, softwood pulp, hardwood pulp, coconut shells, almond shells, grape seeds, walnut shells, macadamia shells, kapok fibers, cotton fibers, cotton linters, and the like. Examples of suitable carbonaceous materials are activated coconut hull based carbons available from Calgon Corp. as PCB and GRC-11 or from PICA as G277, coal-based carbons available from Calgon Corp. as S-Sorb, Sorbite, BPL, CRC-11F, FCA and SGL, wood-based carbons available from Westvaco as WV-B, SA-20 and BSA-20, carbonaceous materials available from Calgon Corp. as HMC, ASC/GR-1 and SC II, Witco Carbon No. 637, and AMBERSORB 572 or AMBERSORB 563 resins available from Rohm and Haas. Other carbonaceous materials are described in U.S. Pat. No. 4,771,795 to White, et al. and U.S. Pat. No. 5,027,837 to Clearman, et al.; and European Patent Application Nos. 236,922; 419,733 and 419,981.

Preferred carbonaceous materials are coconut shell types of activated carbons available from sources such as Calgon Carbon Corporation, Gowrishankar Chemicals, Carbon Activated Corp. and General Carbon Corp. See, also, for example, Activated Carbon Compendium, Marsh (Ed.) (2001), which is incorporated herein by reference.

Certain carbonaceous materials can be impregnated with substances, such as transition metals (e.g., silver, gold, copper, platinum, and palladium), potassium bicarbonate, tobacco extracts, polyethyleneimine, manganese dioxide, eugenol, and 4-ketononanoic acid. The carbon composition may also include one or more fillers, such as semolina. Grape seed extracts may also be incorporated into the filter element 20 as a free radical scavenger.

Various types of charcoals and activated carbon materials suitable for incorporation into cigarette filters, various other filter element component materials, various types of cigarette filter element configurations and formats, and various manners and methods for incorporating carbonaceous materials into cigarette filter elements, are set forth in U.S. Pat. No. 3,217,715 to Berger et al.; U.S. Pat. No. 3,648,711 to Berger et al.; U.S. Pat. No. 3,957,563 to Sexstone; U.S. Pat. No. 4,174,720 to Hall; U.S. Pat. No. 4,201,234 to Neukomm; U.S. Pat. No. 4,223,597 to Lebert; U.S. Pat. No. 5,137,034 to Perfetti et al.; U.S. Pat. No. 5,360,023 to Blakley et al.; U.S. Pat. No. 5,568,819 to Gentry et al.; U.S. Pat. No. 5,622,190 to Arterbery et al.; U.S. Pat. No. 6,537,186 to Veluz; U.S. Pat. No. 6,584,979 to Xue et al.; U.S. Pat. No. 6,761,174 to Jupe et al.; U.S. Pat. No. 6,789,547 to Paine III; and U.S. Pat. No. 6,789,548 to Bereman; US Pat. Appl. Pub. Nos. 2002/0166563 to Jupe et al.; 2002/0020420 to Xue et al.; 2003/0200973 to Xue et al.; 2003/0154993 to Paine et al.; 2003/0168070 to Xue et al.; 2004/0194792 to Zhuang et al.; 2004/0226569 to Yang et al.; 2004/0237984 to Figlar et al.; 2005/0133051 to Luan et al.; 2005/0049128 to Buhl et al.; 2005/0066984 to Crooks et al.; 2006/0144410 to Luan et al.; and 2006/0180164 to Paine, III et al.; U.S. patent application Ser. No. 11/226,932 to Coleman, III et al.; European Pat. Appl. 579410 to White; and PCT WO 2006/064371 to Banerjea et al.; which are incorporated herein by reference. Representative types of cigarettes possessing filter elements incorporating carbonaceous materials have been available as "Benson & Hedges Multifilter" by Philip Morris Inc., in the State of Florida during 2005 as a Philip Morris Inc. test market brand known as "Marlboro Ultra Smooth," and as "Mild Seven" by Japan Tobacco Inc.

The carbonaceous material can be incorporated within a filter element by incorporating that carbonaceous material within paper or other sheet-like material (e.g., as a longitudinally disposed segment of gathered, shredded, or otherwise configured paper-like material), and a plurality of flavor-containing capsules also can be incorporated within that paper-like material or applied to the surface region of that paper-like material. Alternatively, the capsules and carbonaceous material can be incorporated within a segment of a cavity filter (e.g., a particles or granules within the central cavity region of a three-segment or stage filter element). Alternatively, the capsules and carbonaceous material can be dispersed within a fibrous filter material (e.g., as particles or granules dispersed throughout a filter tow or gathered non-woven web material) as a segment of a longitudinally multi-segmented filter element (e.g., a two-segment filter element).

The carbonaceous material is incorporated into, and configured within, the filter element. A typical cigarette filter element of the present invention possesses carbonaceous material within at least one component or segment of the filter element in a manner such that components of at least a portion of the filter element (e.g., filter additives, such as triacetin) can have the ability to come into contact with, and adversely affect the mainstream smoke gas phase removal efficiency of, carbonaceous material within the filter element. Optionally, at least a portion of the carbonaceous material within the filter element is in intimate contact with an effective amount of a mixture of a polyol ester and a polyol. See, for example, U.S. patent application Ser. No. 11/226,932 to Coleman, III et al.

The moisture content of the carbonaceous material or other adsorbent can vary. Typically, the moisture content of the carbonaceous material or other adsorbent within the filter element, prior to use of the cigarette incorporating that filter element, is less than about 30 percent, often less than about 25 percent, and frequently less than about 20 percent, based on the combined weight of the carbonaceous material and moisture. Typically, the moisture content of the carbonaceous material or other adsorbent within the filter element, prior to use of the cigarette incorporating that filter element, is greater than about 3 percent, often greater than about 5 percent, and frequently greater than about 8 percent, based on the combined weight of the carbonaceous material and moisture.

Also disposed within the filter element, in the region, section or segment where the carbonaceous material is located, is a plurality of breakable capsules 52, such as a liquid filled flavor-containing capsules. A representative capsule is generally spherical in shape, and has an outer cover or shell that contains a liquid center region. The liquid center region, which contains a flavorant that is released when the outer shell undergoes some type of physical destruction, breakage, or other loss of physical integrity (e.g., through dispersion, softening, crushing, application of pressure, or the like), thereby provides for altering the sensory properties of the mainstream smoke passing through the filter element. The flavoring agent can also be released through degradation during smoking, such as for example, degradation due to action of moisture in smoke upon the materials of the outer shell of the capsule. As used herein, a flavor agent member is an object containing a flavoring ingredient (as used herein, the terms "flavorant," "flavoring ingredient," or "flavoring agent" refer to substances, such as liquids or solids, that provide a concentrated release for a sensory effect such as, for example, taste, mouth feel, moistness, coolness/heat, and/or fragrance/aroma). Other ingredients that can be incorporated into the capsules or the filter elements of the invention are set forth in U.S. Pat. No. 4,889,144 to Tateno et al.

The capsule payload can have a form that can vary; and typically, the payload has the form of a liquid, a gel, or a solid (e.g., a crystalline material or a dry powder). The payload can incorporate components that aid in flavoring or scenting mainstream cigarette smoke. Alternatively, the payload may be a breath freshening agent for the smoker, a deodorizing agent for the cigarette butt, a moistening or cooling agent for the cigarette smoke, or a composition capable of otherwise altering the nature or character of the cigarette.

In one embodiment, the payload is a mixture of a flavoring agent and a diluting agent or carrier. The preferred diluting agent is a triglyceride, such as a medium chain triglyceride, and more particularly a food grade mixture of medium chain triglycerides. See, for example, Radzuan et al., Porim Bulletin, 39, 33-38 (1999).

Exemplary flavoring agents that can be encapsulated for incorporated within the filter element can be natural or synthetic, and the character of these flavors can be described, without limitation, as fresh, sweet, herbal, confectionary, floral, fruity or spice. Specific types of flavors include, but are not limited to, vanilla, coffee, chocolate, cream, mint, spearmint, menthol, peppermint, wintergreen, lavender, cardamon, nutmeg, cinnamon, clove, cascarilla, sandalwood, honey, jasmine, ginger, anise, sage, licorice, lemon, orange, apple, peach, lime, cherry, and strawberry. See also, Leffingwill et al., Tobacco Flavoring for Smoking Products, R. J. Reynolds Tobacco Company (1972). Flavorings also can include components that are considered moistening, cooling or smoothening agents, such as eucalyptus. These flavors may be provided neat (i.e., alone) or in a composite (e.g., spearmint and menthol, or orange and cinnamon). Composite flavors may be combined in a single capsule as a mixture, or as components of multiple capsules. Preferably, the capsules do not incorporate any tobacco within their outer shells, or within their inner payload regions. However, if desired, other embodiments of capsules may incorporate tobacco (e.g., as finely group tobacco pieces and/or tobacco extracts) within their outer shells and/or within their inner payload regions. See, for example, U.S. Pat. Appl. Pub. No. 2004/0261807 to Dube et al.

The amount of flavoring and diluting agent within the capsule 52 may vary. In some instances, the diluting agent may be eliminated altogether, and the entire payload can be composed of flavoring agent. Alternatively, the payload can be almost entirely comprised of diluting agent, and only contain a very small amount of relatively potent flavoring agent. In one embodiment, the composition of the mixture of flavoring and diluting agent is in the range of about 5 percent to about 75 percent flavoring, and more preferably in the range of about 5 to about 25 percent flavoring, and most preferably in the range of about 10 to about 15 percent, by weight based on the total weight of the payload, with the balance being diluting agent.

The size and weight of each capsule may vary depending upon the desired properties it is to impart to the cigarette. Certain types of capsules are generally spherical in shape. However, suitable capsules may have other types of shapes, such as generally rectilinear, oblong, elliptical, or oval shapes. Exemplary generally spherical capsules have diameters of less than about 3.5 mm, generally less than about 1.5 mm, often less than about 1 mm, and frequently less than about 0.5 mm. For example, several capsules can be employed, and those capsules can be in the range of about 0.25 mm to about 2 mm in diameter. A plurality of very small capsules, commonly referred to as "microcapsules," can be incorporated within the filter element. Certain microcapsules utilized in the invention can be described as granular in size and are barely visible to the naked eye. Exemplary microcapsules may have diameters of less than about 100 microns, such as capsules having diameters in the range of about 1 to about 40 microns, or about 1 micron to about 20 microns.

The total weight of the capsules contained within the filter may vary, but is typically greater than about 10 mg, often greater than about 20 mg, and can be greater than about 30 mg. The total weight of the capsules is typically less than about 200 mg, often less than about 100 mg, and can be less than 50 mg.

Microcapsules have been widely commercially available, and exemplary types of microcapsule technologies are of that type set forth in Gutcho, Microcapsules and Microencapsulation Techniques (1976); Gutcho, Microcapsules and Other Capsules Advances Since 1975 (1979); Kondo, Microcapsule Processing and Technology (1979); Iwamoto et al., AAPS Pharm. Sci. Tech. 2002 3(3): article 25; U.S. Pat. No. 3,550,598 to McGlumphy; U.S. Pat. No. 4,889,144 to Tateno et al.; U.S. Pat. No. 6,117,455 to Takada et al.; and U.S. Pat. No. 6,612,429 to Dennen; and U.S. Pat. Appl. Pub. No. 2006/0174901 to Karles et al.; each of which is incorporated herein by reference. Suitable types of microcapsules are available from sources such as Microtech Laboratories of Dayton, Ohio.

The number of capsules that is incorporated into the filter element can vary. The precise number can vary, depending upon factors such as the size of the capsules, the character or nature of the flavoring agent, the positioning of the capsules within the filter element, and the like. The number of capsules incorporated within the relevant region of the filter element can exceed about 5, can exceed about 10, can exceed about 20, can exceed about 40, and can even exceed about 100. In certain embodiments, the number of capsules can be greater than about 500, and even greater than about 1,000. Larger numbers of capsules in certain embodiments can be advantageous because it can provide the smoker with increased control over flavor release. As opposed to a filter containing a single capsule, the presence of a plurality of capsules allows the smoker to vary the flavor release by continued manipulation of the filter, thereby crushing more capsules and releasing additional flavoring agent.

The crush strength of the capsules is sufficient to allow for normal handling and storage without significant degree of premature or undesirable breakage. The crush strength of the capsules also is sufficiently low so as to allow the smoker to readily break in a purposeful manner during use of the cigarette a significant number of the capsules within the filter element. Providing capsules that possess both suitable integrity and ability to rupture can be determined by experimentation, depending upon factors such as capsule size and type, and is a matter of design choice. See, for example, U.S. patent application Ser. No. 11/234,834 to Thomas et al., which is incorporated herein by reference.

Manners and methods for incorporating both the carbon material and the plurality of capsules into desired regions of the filter elements can vary. Typically, capsules and granules of carbonaceous material can be combined together using traditional types of mixing techniques, and the resulting mixture can be incorporated into "dalmation" types of filter regions using the general types of techniques used for traditional dalmation filter manufacture. Techniques for production of dalmation filters are known, and representative dalmation filters have been provided commercially by Filtrona Greensboro Inc. Alternatively, capsules and granules of carbonaceous material can be combined together using traditional types of mixing techniques, and the resulting mixture can be incorporated into "cavity" types of filter regions using the general types of techniques used for traditional "cavity" filter manufacture. Alternatively, known types of techniques and equipment for producing filter segments incorporating granular materials can be suitably altered so as to introduce capsules and carbonaceous material individually into common regions of those filter segments. In certain embodiments, the capsules and the adsorbent material are applied sequentially rather than as a mixture.

When the capsules and the adsorbent material are mixed together for application to the filter material or a cavity in a filter, the mixture can be an intimate mixture, particularly when a large number of very small particles are employed. For some mixtures, at least some of the capsules and adsorbent particles can be in physical contact with one another.

Both the capsules and the adsorbent, whether applied to the filter material separately or in a mixture, can be applied as a slurry in a suitable solvent (e.g., water), or as free-flowing particulates. The capsules and adsorbent can also be applied within a binder or adhesive matrix.

In certain alternative embodiments, the capsules, particularly when applied in slurry form, can be introduced to the inner surface of the plug wrap surrounding the portion of the filter element containing the adsorbent material, or within the side seam adhesive formulation.

Encapsulated flavoring agents within filter elements possess less of a propensity to migrate to the carbonaceous materials within those filter elements, and also possess less of a propensity to interact with moisture from the environment prior to smoking (e.g., during storage) or moisture from the combustion of tobacco during smoking. As such, flavoring agent is available for incorporation into mainstream smoke when the cigarette is smoked (e.g., by rupturing capsules just prior to, or during, use of the cigarette). In the event that some capsules are inadvertently ruptured during manufacture of the filter element, manufacture of the cigarette, storage of the cigarette or handling of the cigarette, the carbonaceous material has a propensity to hold the resulting prematurely released flavoring agent. As such, the carbonaceous material can provide for a limiting or prevention of undesirable migration of that flavoring agent prior to the use of that cigarette.

If desired, the encapsulating material of the capsules can possess, or be surface treated with, a highly porous, highly absorbent or highly adsorbent material (e.g., a carbonaceous material having a higher ability to attract and contain tobacco flavoring agents, other migratable cigarette components, moisture, and the like). As such, the carbonaceous material that is intended to provide alternation of the character or nature of the mainstream smoke during use of the cigarette is somewhat protected from being "poisoned" by moisture or certain cigarette ingredients during periods of handling and storage.

Preferred cigarettes of the present invention exhibit desirable resistance to draw. For example, an exemplary cigarette exhibits a pressure drop of between about 50 and about 200 mm water pressure drop at 17.5 cc/sec. air flow. Preferred cigarettes exhibit pressure drop values of between about 60 mm and about 180, more preferably between about 70 mm to about 150 mm, water pressure drop at 17.5 cc/sec. air flow. Typically, pressure drop values of cigarettes are measured using a Filtrona Cigarette Test Station (CTS Series) available form Filtrona Instruments and Automation Ltd.

Filter elements of the present invention can be incorporated within the types of cigarettes set forth in U.S. Pat. No. 4,756,318 to Clearman et al.; U.S. Pat. No. 4,714,082 to Banerjee et al.; U.S. Pat. No. 4,771,795 to White et al.; U.S. Pat. No. 4,793,365 to Sensabaugh et al.; U.S. Pat. No. 4,989,619 to Clearman et al.; U.S. Pat. No. 4,917,128 to Clearman et al.; U.S. Pat. No. 4,961,438 to Korte; U.S. Pat. No. 4,966,171 to Serrano et al.; U.S. Pat. No. 4,969,476 to Bale et al.; U.S. Pat. No. 4,991,606 to Serrano et al.; U.S. Pat. No. 5,020,548 to Farrier et al.; U.S. Pat. No. 5,027,836 to Shannon et al.; U.S. Pat. No. 5,033,483 to Clearman et al.; U.S. Pat. No. 5,040,551 to Schlatter et al.; U.S. Pat. No. 5,050,621 to Creighton et al.; U.S. Pat. No. 5,052,413 to Baker et al.; U.S. Pat. No. 5,065,776 to Lawson; U.S. Pat. No. 5,076,296 to Nystrom et al.; U.S. Pat. No. 5,076,297 to Farrier et al.; U.S. Pat. No. 5,099,861 to Clearman et al.; U.S. Pat. No. 5,105,835 to Drewett et al.; U.S. Pat. No. 5,105,837 to Barnes et al.; U.S. Pat. No. 5,115,820 to Hauser et al.; U.S. Pat. No. 5,148,821 to Best et al.; U.S. Pat. No. 5,159,940 to Hayward et al.; U.S. Pat. No. 5,178,167 to Riggs et al.; U.S. Pat. No. 5,183,062 to Clearman et al.; U.S. Pat. No. 5,211,684 to Shannon et al.; U.S. Pat. No. 5,240,014 to Deevi et al.; U.S. Pat. No. 5,240,016 to Nichols et al.; U.S. Pat. No. 5,345,955 to Clearman et al.; U.S. Pat. No. 5,396,911 to Casey, III et al.; U.S. Pat. No. 5,551,451 to Riggs et al.; U.S. Pat. No. 5,595,577 to Bensalem et al.; U.S. Pat. No. 5,727,571 to Meiring et al.; U.S. Pat. No. 5,819,751 to Barnes et al.; U.S. Pat. No. 6,089,857 to Matsuura et al.; U.S. Pat. No. 6,095,152 to Beven et al; and U.S. Pat. No. 6,578,584 Beven; which are incorporated herein by reference. For example, filter elements of the present invention can be incorporated within the types of cigarettes that have been commercially marketed under the brand names "Premier" and "Eclipse" by R. J. Reynolds Tobacco Company. See, for example, those types of cigarettes described in Chemical and Biological Studies on New Cigarette Prototypes that Heat Instead of Burn Tobacco, R. J. Reynolds Tobacco Company Monograph (1988) and Inhalation Toxicology, 12:5, p. 1-58 (2000); which are incorporated herein by reference.

Many modifications and other embodiments of the invention will come to mind to one skilled in the art to which this invention pertains having the benefit of the teachings presented in the foregoing description; and it will be apparent to those skilled in the art that variations and modifications of the present invention can be made without departing from the scope or spirit of the invention. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A filtered cigarette comprising a smokable rod and a filter element attached thereto, the filter element comprising a first segment of fibrous tow filter material positioned at the mouth end of the cigarette and a second segment of fibrous tow filter material positioned between the first segment of filter material and the smokable rod, wherein an adsorbent and an encapsulated flavoring agent are dispersed throughout said second segment of filter material, and wherein the first segment of filter material is substantially free of adsorbent and encapsulated flavoring agent.

2. The filtered cigarette of claim 1, wherein the adsorbent is selected from the group consisting of activated carbon, molecular sieves, clays, ion exchange resins, activated aluminas, silica gels, meerschaum, and mixtures thereof.

3. The filtered cigarette of claim 1, wherein the adsorbent is in granular form.

4. The filtered cigarette of claim 3, wherein the adsorbent has a particle size of about 10 Mesh to about 400 Mesh.

5. The filtered cigarette of claim 4, wherein the adsorbent has a particle size of about 30 Mesh to about 200 Mesh.

6. The filtered cigarette of claim 1, wherein the adsorbent is a carbonaceous material in granular form.

7. The filtered cigarette of claim 6, wherein the carbonaceous material has an activity of about 60 to about 150 Carbon Tetrachloride Activity.

8. The filtered cigarette of claim 1, wherein the adsorbent is present in an amount of about 20 mg to about 500 mg.

9. The filtered cigarette of claim 8, wherein the adsorbent is present in an amount of about 40 mg to about 200 mg.

10. The filtered cigarette of claim 1, wherein the encapsulated flavoring agent is in the form of a plurality of breakable capsules.

11. The filtered cigarette of claim 10, wherein each breakable capsule comprises an outer shell and a payload comprising a flavoring agent contained within the shell.

12. The filtered cigarette of claim 11, wherein the payload comprises a flavoring agent and a carrier.

13. The filtered cigarette of claim 10, wherein the number of capsules is between about 5 and about 1,000.

14. The filtered cigarette of claim 13, wherein the number of capsules is between about 20 and about 500.

15. The filtered cigarette of claim 10, wherein each capsule has a diameter of between about 0.25 mm and about 3.5 mm.

16. The filtered cigarette of claim 10, wherein the capsules are in the form of microcapsules.

17. The filtered cigarette of claim 16, wherein each microcapsule has a diameter of about 1 to about 40 microns.

18. The filtered cigarette of claim 10, wherein the total weight of the capsules is between about 10 mg and about 200 mg.

19. The filtered cigarette of claim 1, wherein the flavoring agent is selected from the group consisting of vanilla, coffee, chocolate, cream, mint, spearmint, menthol, peppermint, wintergreen, lavender, cardamon, nutmeg, cinnamon, clove, cascarilla, sandalwood, honey, jasmine, ginger, anise, sage, licorice, lemon, orange, apple, peach, lime, cherry, strawberry, and eucalyptus.

20. The filtered cigarette of claim 1, wherein the filter element comprises 2 to about 4 segments of filter material.

21. The filtered cigarette of claim 20, wherein each segment of filter material comprises a fibrous tow.

22. The filtered cigarette of claim 1, wherein the flavoring agent is a cooling agent.

23. A filter element adapted for use with smoking articles, the filter element comprising a first segment of fibrous tow filter material and a second segment of fibrous tow filter material, wherein the first segment of fibrous tow filter material comprises a granular adsorbent material and a plurality of breakable capsules dispersed therein, the breakable capsules comprising a flavoring agent, and wherein the second segment is substantially free of granular adsorbent and breakable capsules.

24. The filter element of claim 23, wherein the fibrous tow filter material is a cellulose acetate tow or a polyolefin tow.

25. The filter element of claim 23, wherein the granular adsorbent is a carbonaceous material.

26. The filter element of claim 23, wherein the flavoring agent is a cooling agent.

27. A cigarette comprising:

(a) a tobacco rod having a smokable filler material contained within a circumscribing wrapping material;

(b) a filter element connected to the tobacco rod at one end of the tobacco rod, said filter element comprising a mouth end segment of fibrous tow filter material and a tobacco end segment of fibrous tow filter material;

(c) a granular carbonaceous material dispersed within the tobacco end segment of filter material; and (d) a plurality of breakable capsules dispersed within the tobacco end segment of filter material, the capsules comprising an outer shell and a liquid or gel payload, the payload comprising a flavoring agent, wherein the mouth end segment of fibrous tow filter material is substantially free of carbonaceous material and breakable capsules.

28. The cigarette of claim 27, wherein the flavoring agent is a cooling agent.

* * * * *